United States Patent [19]

Wilson

[11] 4,191,337

[45] Mar. 4, 1980

[54] APPARATUS FOR BREAKING UP VEGETABLE MATTER

[75] Inventor: Clifford A. Wilson, Nassau, The Bahamas

[73] Assignee: Rotocrop International, Ltd., Nassau, The Bahamas

[21] Appl. No.: 857,978

[22] Filed: Dec. 6, 1977

[30] Foreign Application Priority Data

Oct. 31, 1977 [GB] United Kingdom ..... 45276/77

[51] Int. Cl.[2] ..... B02C 18/18

[52] U.S. Cl. ..... 241/224; 241/242

[58] Field of Search ..... 241/221, 222, 224, 225, 241/242, 277; 56/294

[56] References Cited

U.S. PATENT DOCUMENTS

| | | | |
|---|---|---|---|
| 2,772,533 | 12/1956 | Shibley, Jr. | 56/294 X |
| 3,217,765 | 11/1965 | Anderson | 241/225 X |
| 3,514,934 | 6/1970 | Cassady | 56/294 |
| 3,817,464 | 6/1974 | Sousek | 241/222 |

*Primary Examiner*—Howard N. Goldberg

*Attorney, Agent, or Firm*—Allegretti, Newitt, Witcoff & McAndrews

[57] ABSTRACT

Apparatus for breaking up vegetable matter is disclosed. The apparatus may be stationary, material being delivered thereto for treatment, or mobile; e.g., a lawn mower which is moved over a lawn to cut grass. Other mobile embodiments will include apparatus for reaping or harvesting crops more generally. In both the stationary and mobile forms, the apparatus disclosed includes an elliptical blade obliquely mounted on a shaft such that the periphery of the blade generates a cylindrical surface upon rotation of the shaft. Material is cut by the shearing engagement of the periphery of the blade with an edge lying on the cylindrical surface. Cut material is carried into the rotational "cylinder" and discharged radially therefrom. In preferred stationary embodiments of the invention the "cylinder" will be positively defined by a drum having inlet and outlet openings in the cylindrical surface thereof, the openings defining the edge at which initial cutting is effected. In preferred mobile embodiments, the cutting edge will be formed on a plate extending around a part of the cylindrical surface to the point of discharge.

6 Claims, 5 Drawing Figures

APPARATUS FOR BREAKING UP VEGETABLE MATTER

BACKGROUND TO THE INVENTION

This invention relates to apparatus for breaking up vegetable matter and more particularly to apparatus for reducing organic garden waste to small pieces more readily susceptible to composting or more easily disposed of by other means. The apparatus may be either stationary, material being delivered thereto for treatment, or mobile, the apparatus being adapted to reap or harvest. A typical such mobile apparatus is a lawn mower.

By increasing the exterior surface of organic materials through cutting, shredding and beating, more material can be exposed to decomposing bacteria. By reducing wastes like twigs and dead leaves (usually harder, older wastes) to shapes of about half an inch across, pockets of air are capable of being formed in a bin of such material. This ventilation assists in providing air to the aerobic bacteria and as a consequence faster and more complete decomposition will result. It is of course important that the broken up matter does not comprise too fine particles, to ensure that a heap or bin does not become clogged.

Even if composting is not the intention, organic material broken into small pieces takes up less space and is more easily handled than it would be otherwise. Thus, it may be bagged, transported or shovelled with ease.

SUMMARY OF THE INVENTION

The present invention resides in the use of an elliptical blade to break up material fed thereto. The blade is obliquely mounted on a shaft such that the periphery of the blade generates a cylindrical surface upon rotation of the shaft. As the shaft rotates, the blade periphery is in shearing engagement with an edge lying on the cylindrical surface, whereby matter fed to the blade will be broken up.

Where the apparatus is to be a standing construction, a delivery passage will be provided through which the organic matter is fed. Thus, according to a first aspect of the invention the apparatus will comprise a frame supporting a rotatable shaft having an elliptical blade mounted thereon such that the periphery of the blade generates a cylindrical surface upon rotation of the shaft; and a housing defining a delivery passage for said vegetable matter terminating in an opening having two spaced edges, at least one of which lies on said cylindrical surface for shearing engagement with the periphery of the blade as the shaft rotates, the arrangement being such that vegetable matter fed to the delivery passage is broken up as it passes through said opening, and discharged radially across the cylindrical surface.

Although not essential, the surface which provides the edge against which the blade shears will normally extend around the cylindrical surface generated by the blade periphery towards an outlet whereby cut material is also swept away from the cutting area. This takes the form of a drum having an inlet opening in one side and a discharge aperture substantially opposite the opening. By vertically aligning the opening and aperture, gravity will assist in maintaining a flow of material therethrough.

BRIEF DESCRIPTION OF THE DRAWINGS

Two embodiments of the invention will now be described by way of example and with reference to the accompanying drawings wherein.

DESCRIPTION OF PREFERRED EMBODIMENTS

Figure 1:
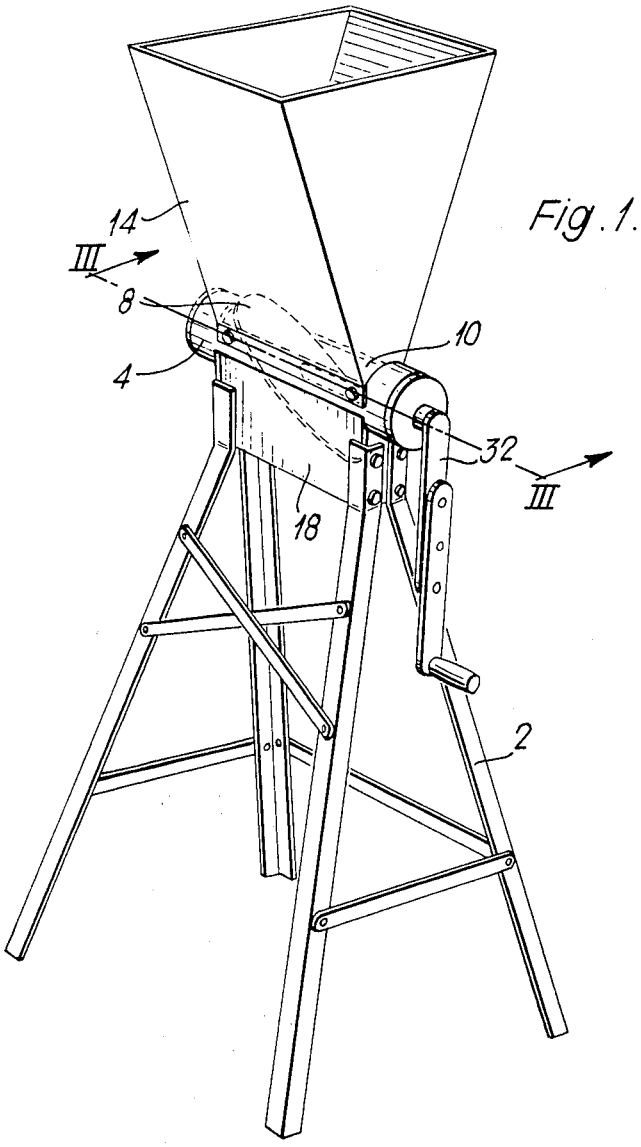
FIG. 1 is a perspective view of a shredder constructed in accordance with the first aspect of the invention.
Figure 2:
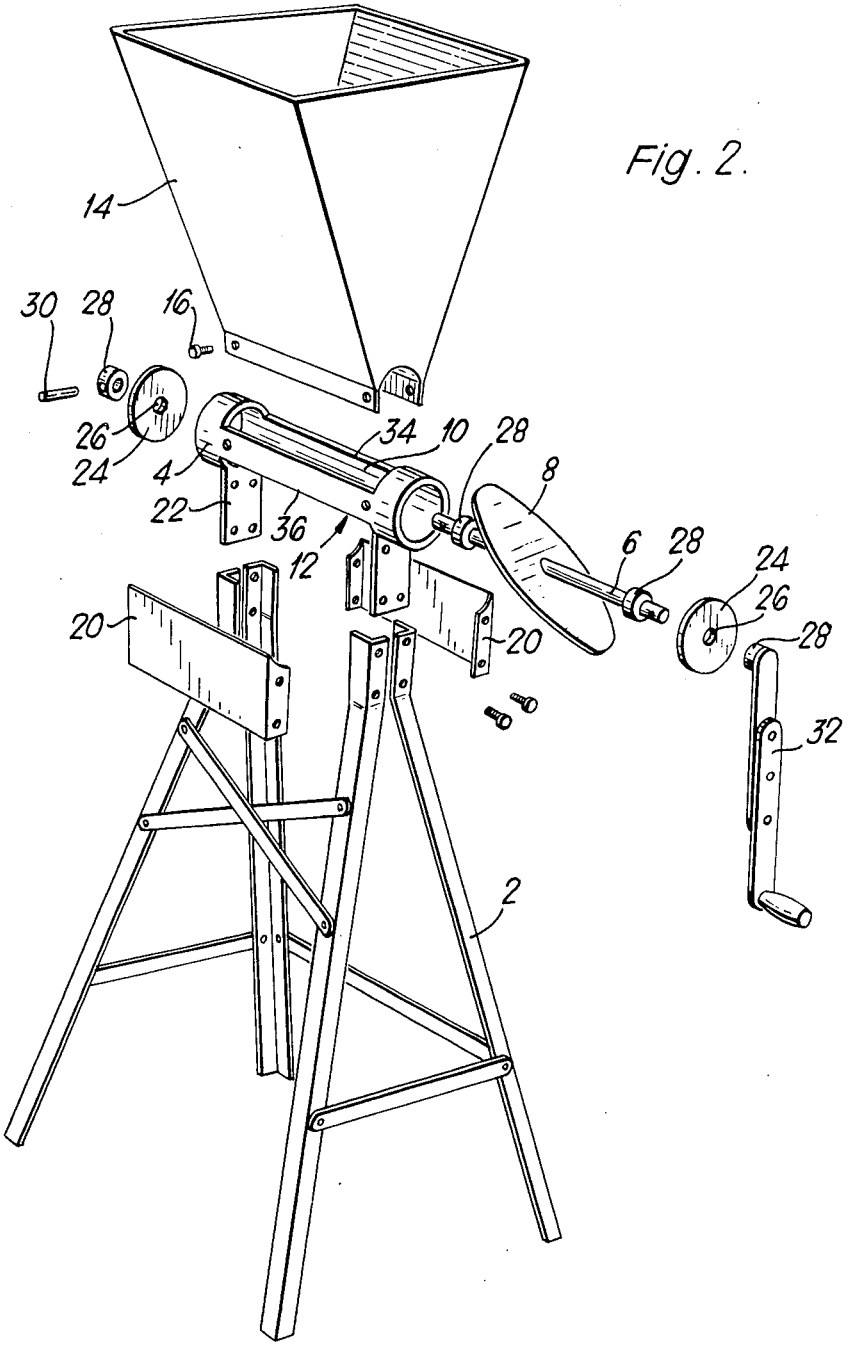
FIG. 2 is an exploded perspective view of the shredder shown in FIG. 1.

Referring to FIGS. 1 and 2, a shredder comprises a frame 2 supporting a cylindrical drum 4 in which a shaft 6 having an elliptical blade 8 is obliquely mounted thereon. The drum 4 is provided with an inlet opening 10 and an outlet aperture 12 disposed vertically therebelow. A housing 14 is secured to the drum 4 by bolts 16 and defines a delivery passage for organic matter terminating at the opening 10. A discharge duct 18 formed of side plates 20 and end plates 22 extends downwardly from the aperture 12 and forms the means by which the drum is supported on the frame. Conveniently, the end plates 22 are integral with the drum.

The shaft 6 is supported in plane journal bearings at either end of the drum 4 consisting of caps 24 having a centrally disposed appropriately sized hole 26. Collars 28 determine the longitudinal position of the shaft 6 and are secured on the shaft by pins 30. A handle 32 is secured to one of the end collars 28. The end caps may be either welded in place or removably secured to the drum to permit inspection and where necessary replacement of the shaft or bearing elements.

Figure 3:
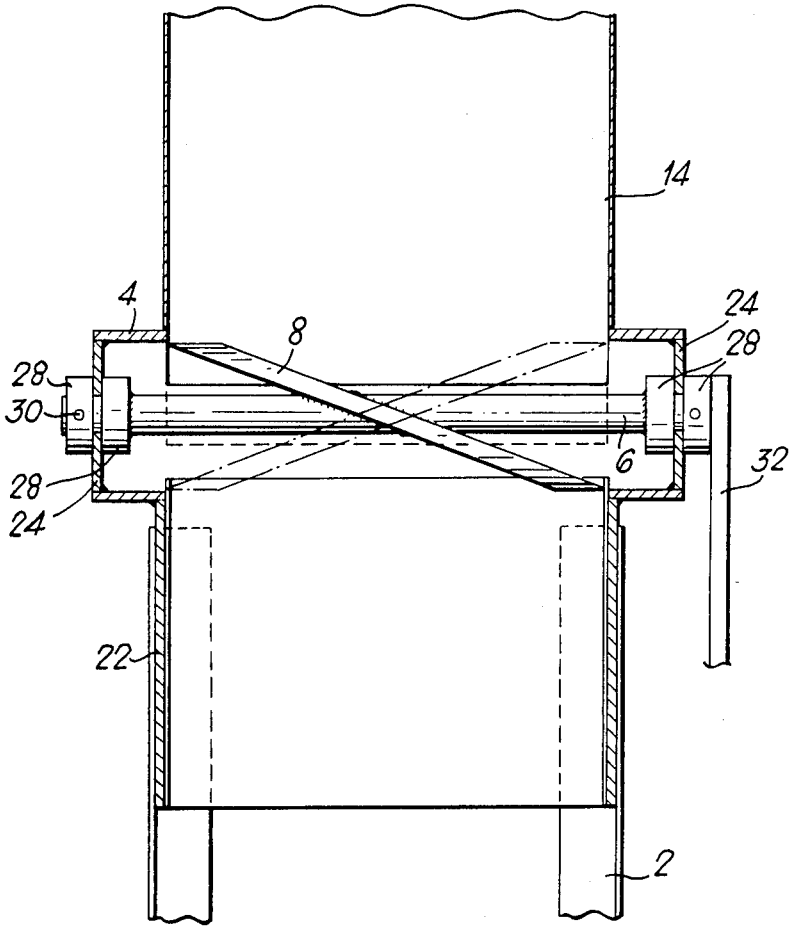
FIG. 3 is a sectional elevation (to a larger scale) taken on the line III—III of FIG. 1 but showing the blade and shaft in full.
Figure 4:
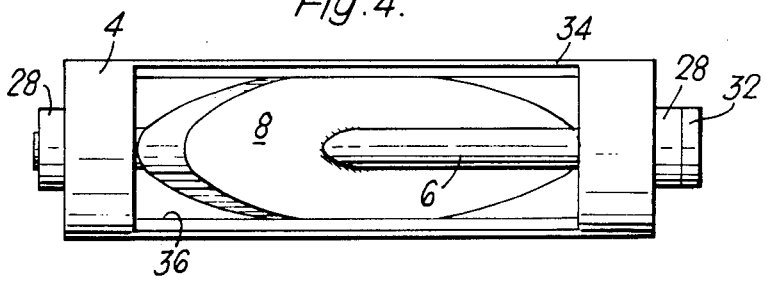
FIG. 4 is a plan view of the drum shown in FIG. 1 with the blade and shaft in place.

The nature of the blade 8 is shown more clearly in FIGS. 3 and 4. The blade 8 is a slice cut at an angle from a round bar of diameter equal to that of the internal surface of the drum 4, and the shape of each edge of the slice is a true ellipse. A hole is formed centrally of the slice through which the shaft 6 passes and is welded thereto. Thus, as the shaft 6 rotates, the periphery of the blade 8 is in continuous contact with the inner cylindrical surface of the drum 4. As the shaft 6 is rotated clockwise as viewed from the right in FIGS. 3 and 4, the blade periphery will be in continuous shearing engagement with edge 34 of the opening 10 and edge 36 of the aperture 12. In this way, organic matter may be cut both as it enters and as it departs from the drum 4. The edges 34 and 36 are shown substantially parallel to the shaft axis, but it will be appreciated that this is not essential.

Although the cutting edge of the blade 8 may be formed separately, and secured to the shaft 6 by means of a more lightweight framework, a solid blade is preferred as it can therefore also serve to sweep matter from the inlet opening 10 around to the discharge aperture 12.

Figure 5:
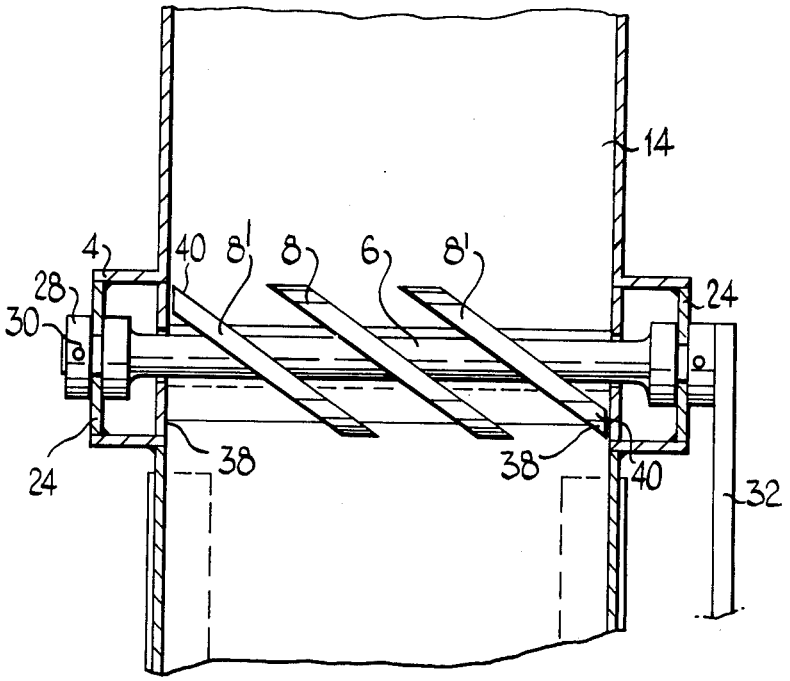
FIG. 5 is a view, similar to FIG. 3, illustrating an alternative embodiment of the invention.

The periphery at least of the blade is normally case hardened and the cutting edges 34 and 36 may be sharpened by filing as and when necessary. If desired, the axial ends of the blade may be dispensed with, either by removal or by reducing the axial length of the opening 10 and aperture 12. In this way only those portions of the blade periphery which approach parallelism with the cutting edges 34 and 36 need be effective. If the axial ends of the blade are removed, as shown in the modified embodiment of FIG. 5, auxiliary end plates 38 which traverse the drum 4 adjacent the cut ends 40, may be included to prevent clogging. FIG. 5 also shows a plurality of blades 8 and 8', which may most usefully be employed to increase the frequency of cutting at a given section and it is where a number of blades are used that the remote ends of the most axially spaced blades may be dispensed with. It will be appreciated that the apparatus may be adapted to cut in either rotational direction of the shaft 6.

Most of the components of the shredder will be made of steel but the hopper or housing 14 is conveniently a plastics moulding. More sophisticated bearings for the shaft may also be used.

Shredders according to the invention may be of any desired size. The one illustrated is hand driven, the level of the shaft being approximately 3 feet above the base of the frame 2. Shredders of larger capacity might be motor driven, normally through a reduction gear. Very large apparatus for heavy material could usefully employ a flywheel to maintain inertia.

I claim:

1. Apparatus for breaking up organic matter comprising a frame supporting a rotatable shaft having an elliptical blade mounted thereon such that the periphery of the blade generates a cylindrical surface upon rotation of the shaft; and a housing defining a delivery passage for said vegetable matter and including a drum in which the shaft rotates, said delivery passage terminating in an opening formed in the drum with two spaced edges, at least one of which lies on said cylindrical surface for shearing engagement with the periphery of the blade as the shaft rotates, and the drum defining a discharge aperture substantially opposite said opening, the arrangement being such that vegetable matter fed to the delivery passage is broken up as it passes through said opening, and discharged radially across the cylindrical surface through said aperture.

2. Apparatus according to claim 1 wherein the internal surface of the drum coincides with said cylindrical surface adjacent the opening.

3. Apparatus according to claim 2 wherein the entire internal surface of the drum coincides with said cylindrical surface.

4. Apparatus according to claim 1 wherein the two spaced edges defining said opening are each parallel to the axis of the shaft.

5. Apparatus according to claim 1 wherein the axial ends of the elliptical blade are cut away, the apparatus including drum end plates traversing the drum adjacent said ends of the blade, and wherein said opening is bounded by the end plates.

6. Apparatus according to claim 1 including a plurality of elliptical blades obliquely mounted on the shaft.

* * * * *